US008827839B2

(12) United States Patent
Watanabe et al.

(10) Patent No.: US 8,827,839 B2
(45) Date of Patent: Sep. 9, 2014

(54) MULTI-PIECE SOLID GOLF BALL

(75) Inventors: Hideo Watanabe, Saitamaken (JP); Junji Umezawa, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 767 days.

(21) Appl. No.: 12/971,795

(22) Filed: Dec. 17, 2010

(65) Prior Publication Data

US 2012/0157233 A1 Jun. 21, 2012

(51) Int. Cl.
*A63B 37/06* (2006.01)
*A63B 37/00* (2006.01)

(52) U.S. Cl.
CPC ..... *A63B 37/0031* (2013.01); *A63B 37/0033* (2013.01); *A63B 37/0064* (2013.01); *A63B 37/0092* (2013.01); *A63B 37/0043* (2013.01); *A63B 37/0076* (2013.01); *A63B 37/0045* (2013.01); *A63B 37/0062* (2013.01)
USPC ..... 473/376

(58) Field of Classification Search
USPC ..... 473/376
See application file for complete search history.

(56) References Cited

U.S. PATENT DOCUMENTS

| | | | | |
|---|---|---|---|---|
| 5,725,442 | A | 3/1998 | Higuchi et al. | |
| 5,733,205 | A | 3/1998 | Higuchi et al. | |
| 6,251,031 | B1 | 6/2001 | Hayashi et al. | |
| 6,302,808 | B1 | 10/2001 | Dalton et al. | |
| 6,416,425 | B1 | 7/2002 | Maruko et al. | |
| 6,419,595 | B1 | 7/2002 | Maruko et al. | |
| 6,527,652 | B1 | 3/2003 | Maruko et al. | |
| 6,565,456 | B2 | 5/2003 | Hayashi et al. | |
| 6,743,122 | B2 * | 6/2004 | Hayashi et al. | 473/376 |
| 2005/0170909 | A1 | 8/2005 | Hayashi | |
| 2009/0111611 | A1 * | 4/2009 | Kimura et al. | 473/373 |
| 2009/0170634 | A1 | 7/2009 | Loper et al. | |

FOREIGN PATENT DOCUMENTS

| | | | |
|---|---|---|---|
| JP | 9-56848 | A | 3/1970 |
| JP | 8-336618 | A | 12/1996 |
| JP | 2000-60997 | A | 2/2000 |
| JP | 2000-61000 | A | 2/2000 |
| JP | 2000-61001 | A | 2/2000 |
| JP | 2000-61002 | A | 2/2000 |
| JP | 2001-17569 | A | 1/2001 |
| JP | 2001-17570 | A | 1/2001 |
| JP | 2001-37914 | A | 2/2001 |
| JP | 2001-218872 | A | 8/2001 |
| JP | 2005-218859 | A | 8/2005 |
| JP | 2009-160407 | A | 7/2009 |

* cited by examiner

*Primary Examiner* — Raeann Gorden
(74) *Attorney, Agent, or Firm* — Sughrue Mion, PLLC

(57) ABSTRACT

A multi-piece solid golf ball has an elastomer core, an envelope layer encasing the core, an intermediate layer encasing the envelope layer, and an outer layer encasing the envelope layer and has dimples formed on a surface thereof. The envelope layer is formed of an inner envelope layer and an outer envelope layer, and the intermediate layer is formed of an inner intermediate layer and an outer intermediate layer. Letting the average hardness of the core be expressed by the formula: average core hardness (Shore D)=[core surface hardness (Shore D)+core center hardness (Shore D)]/2, the outer layer has a hardness (Shore D) which is higher than the average core hardness and each of the envelope layers and the intermediate layers is softer than the outer layer. The multi-piece solid golf ball provides a good, soft feel on impact and excellent flight for golfers not having a very high head speed.

19 Claims, 2 Drawing Sheets

MULTI-PIECE SOLID GOLF BALL

BACKGROUND OF THE INVENTION

The present invention relates to a multi-piece solid golf ball composed of a core, an envelope layer, an intermediate layer and an outer layer that have been formed as successive layers. More specifically, the invention relates to a multi-piece solid golf ball in which importance is placed on achieving an excellent flight when the ball played by ordinary amateur golfers who do not have a very high head speed, and on having a good, soft feel on impact.

Key performance features required in a golf ball include distance, controllability, durability and feel on impact. Balls endowed with these qualities in the highest degree are constantly being sought. Among recent golf balls, there has emerged a succession of balls which have multilayer structures and are typically composed of three pieces. By making the structure of a golf ball multilayered, it is possible to combine numerous materials of differing properties, thus enabling a wide variety of ball designs in which each layer has a particular function.

Also, golf balls in which importance is placed on distance and a soft feel are widely used as balls for ordinary amateur golfers. Therefore, a major challenge is to design the thickness and hardness of the respective layers of the ball in such a way as to maximize these effects. Yet, there are limitations in the design of hardnesses and thicknesses in two-piece solid golf balls and three-pieces solid golf balls. Numerous disclosures, such as those indicated below, have been made on multilayer balls having four pieces or five pieces.

Golf balls with such a multilayer structure have been disclosed in, for example, JP-A 2009-160407, U.S. Pat. No. 6,302,808, JP-A 2001-017569, JP-A 2001-017570, JP-A 2001-037914, JP-A 2000-61002, JP-A 2000-60997, JP-A 2000-61000, JP-A 2000-61001, JP-A 2001-218872, JP-A 2005-218859, JP-A 8-336618 and JP-A 9-56848.

However, in such prior-art golf balls with a multilayer structure, because importance is often placed on numerous qualities other than flight, such as spin rate on approach shots, feel on impact and durability, they lack a sufficient spin rate-lowering effect on full shots, leaving room for further improvement in the distance traveled on shots with a driver.

SUMMARY OF THE INVENTION

It is therefore an object of the present invention to provide a multi-piece solid golf ball which is able to achieve an excellent flight when played by ordinary amateur golfers who do not have a very high head speed, and a good, soft feel on impact.

The inventors have conducted extensive investigations in order to attain the above object. As a result, they have discovered that, by adopting a basic ball construction wherein the layers encasing the core have a multilayer structure of five or more layers which includes, in order from the inner side: an inner envelope layer, an outer envelope layer, an inner intermediate layer, an outer intermediate layer and an outer layer, by having the core composed of an elastomer, and by designing the ball hardness in such a way that, when the average hardness in the core is expressed by the following formula average core hardness (Shore *D*)=[core surface hardness (Shore *D*)+core center hardness (Shore *D*)]/2, the outer layer hardness (Shore D) is higher than the average core hardness and the envelope layers and the intermediate layers are each softer than the outer layer, the ball is capable of both achieving an excellent flight when played by ordinary amateur golfers who do not have a very high head speed and of exhibiting a good, soft feel on impact.

That is, the multi-piece solid golf ball of the present invention, by basically having a multilayer construction of six or more layers in which at least five cover layers are formed over a core and having the outer layer be relatively hard, is able to achieve both a low spin rate and a high rebound. In addition, owing to an exquisite combination of hardnesses and thicknesses among the respective layers other than the outer layer (i.e., the inner envelope layer, outer envelope layer, inner intermediate layer and outer intermediate layer), the spin rate is reduced and the rebound is increased on full shots, enabling an excellent distance to be obtained. Moreover, a good, soft feel can be achieved on full shots.

Accordingly, the invention provides the following multi-piece solid golf ball.

[1] A multi-piece solid golf ball comprising a core, an envelope layer encasing the core, an intermediate layer encasing the envelope layer, and an outer layer which encases the envelope layer and has formed on a surface thereof a plurality of dimples, wherein the core is made of an elastomer, the envelope layer is formed of an inner envelope layer and an outer envelope layer, the intermediate layer is formed of an inner intermediate layer and an outer intermediate layer, and, letting the average hardness of the core be expressed by the following formula:

average core hardness (Shore *D*)=[core surface hardness (Shore *D*)+core center hardness (Shore *D*)]/2, the outer layer has a hardness (Shore D) which is higher than the average core hardness and each of the envelope layers and the intermediate layers is softer than the outer layer.

[2] The multi-piece solid golf ball of [1], wherein the envelope layers, the intermediate layers and the outer layer have Shore D hardnesses which satisfy the following relationship:

outer layer hardness>outer intermediate layer hardness>inner intermediate layer hardness>outer envelope layer hardness>inner envelope layer hardness.

[3] The multi-piece solid golf ball of [1], wherein the core, the envelope layers, the intermediate layers and the outer layer have Shore D hardnesses which satisfy the following five relationships:

3≤(outer layer hardness−outer intermediate layer hardness)≤20,

1≤(outer intermediate layer hardness−inner intermediate layer hardness)≤10,

1≤(inner intermediate layer hardness−outer envelope layer hardness)≤10,

1≤(outer envelope layer hardness−inner envelope layer hardness)≤10, and

5≤(outer layer hardness−average core hardness)≤40.

[4] The multi-piece solid golf ball of [1], wherein the envelope layers, the intermediate layers and the outer layer have thicknesses which satisfy the following relationship:

1≤(outer intermediate layer thickness+inner intermediate layer thickness+outer envelope layer thickness+inner envelope layer thickness)/outer layer thickness≤4.0.

[5] The multi-piece solid golf ball of [1], wherein the outer layer is formed of a material composed primarily of an ionomer, and the outer layer material includes one or more type of ionomer resin having an acid content of at least 16 wt %.

[6] The multi-piece solid golf ball of [1], wherein the core, envelope layers, intermediate layers and outer layer have Shore D hardnesses which satisfy the following relationship:

outer layer hardness>outer intermediate layer hardness>inner intermediate layer hardness>outer envelope layer hardness>inner envelope layer hardness>center core hardness.

[7] The multi-piece solid golf ball of [1], wherein the envelope layers, intermediate layers and outer layer have thicknesses which satisfy the following relationship:

outer layer thickness≤(outer intermediate layer thickness+inner intermediate layer thickness+outer envelope layer thickness+inner envelope layer thickness)<core diameter.

[8] The multi-piece solid golf ball of [1], wherein at least one layer from among the inner envelope layer, outer envelope layer, inner intermediate layer and outer intermediate layer is formed of a material obtained by blending:

an ionomer resin component of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50.

[9] The multi-piece solid golf ball of [1], wherein at least one layer from among the inner envelope layer, outer envelope layer, inner intermediate layer and outer intermediate layer is formed of a material obtained by blending:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from 5 to 120 parts by weight of a fatty acid and/or fatty acid derivative having a molecular weight of from 228 to 1500; and (d) from 0.1 to 17 parts by weight of a basic inorganic metal compound capable of neutralizing un-neutralized acid groups in the base resin and component (c).

[10] The multi-piece solid golf ball wherein at least two layers from among the inner envelope layer, outer envelope layer, inner intermediate layer and outer intermediate layer are formed of the material of [9].

[11] The multi-piece solid golf ball wherein at least three layers from among the inner envelope layer, outer envelope layer, inner intermediate layer and outer intermediate layer are formed of the material of [9].

[12] The multi-piece solid golf ball wherein the inner envelope layer, outer envelope layer, inner intermediate layer and outer intermediate layer are all formed of the material of [9].

[13] The multi-piece solid golf ball of [1], wherein the core, envelope layers, intermediate layers and outer layer have thicknesses which satisfy the following four relationships:

0.75≤(outer intermediate layer thickness+inner intermediate layer thickness)/outer layer thickness≤1.5, 0.75≤(outer envelope layer thickness+inner envelope layer thickness)/outer layer thickness≤1.5, 0.75≤(outer intermediate layer thickness+inner intermediate layer thickness)/(outer envelope layer thickness+inner envelope layer thickness)≤1.5, and outer layer thickness<(outer intermediate layer thickness+inner intermediate layer thickness+outer envelope layer thickness+inner envelope layer thickness)<core diameter.

BRIEF DESCRIPTION OF THE DIAGRAMS

DETAILED DESCRIPTION OF THE INVENTION

The invention is described more fully below.

Figure 1:
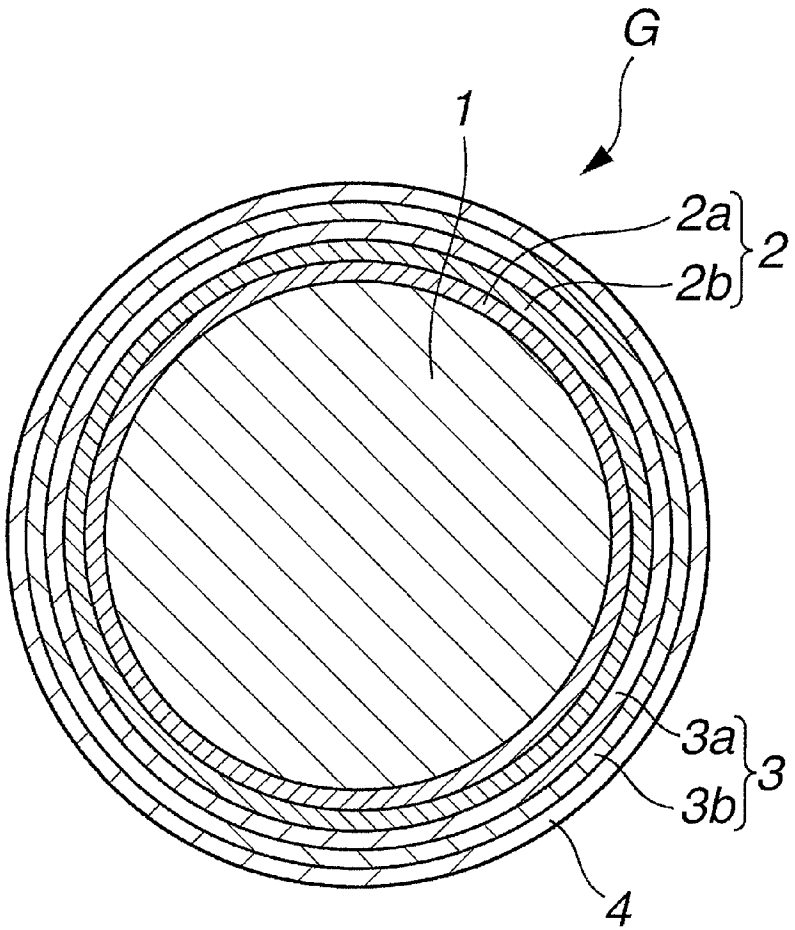
FIG. 1 is a schematic sectional view showing a multi-piece solid golf ball (six-layer construction) according to the invention.

The multi-piece solid golf ball of the present invention, as shown in FIG. 1, is a golf ball G having a core 1, an envelope 2 encasing the core, an intermediate layer 3 encasing the envelope layer, and an outer layer 4 encasing the intermediate layer. In addition, the envelope layer 2 is formed of two layers—an inner envelope layer 2*a* and an outer envelope layer 2*b*, and the intermediate layer 3 is formed of two layers—an inner intermediate layer 3*a* and an outer intermediate layer 2*b*. The outer layer 4 shown in FIG. 1 typically has a large number of dimples formed on the surface thereof, although the dimples are not depicted in FIG. 1. The core 1 is not limited to a single layer, and may be formed of a plurality of two or more layers.

In the invention, the core has a diameter which, although not subject to any particular limitation, is preferably at least 20 mm, more preferably at least 30 mm, and even more preferably at least 34 mm. The diameter upper limit, although not subject to any particular limitation, is preferably not more than 38 mm, more preferably not more than 37 mm, and even more preferably not more than 36 mm. At a core diameter outside this range, the ball may have a lower initial velocity and the spin rate-lowering effect when the ball is hit with a driver may be inadequate, as a result of which an increased distance may not be achieved.

The core has a surface hardness which, although not subject to any particular limitation, has a JIS-C hardness value of preferably at least 50, more preferably at least 60, and even more preferably at least 70. The upper limit, although not subject to any particular limitation, is preferably not more than 95, more preferably not more than 90, and even more preferably not more than 85. The above hardness range, expressed as the Shore D hardness, is preferably at least 30, more preferably at least 38, and even more preferably at least 45. The upper limit is preferably not more than 64, more preferably not more than 60, and even more preferably not more than 57.

The core has a center hardness which may be set to a JIS-C hardness value of preferably at least 40, more preferably at least 45, and even more preferably at least 50. The upper limit is preferably not more than 72, more preferably not more than 68, and even more preferably not more than 65. The above hardness range, when expressed as the Shore D hardness, is preferably at least 22, more preferably at least 26, and even more preferably at least 30. The upper limit is preferably not more than 47, more preferably not more than 44, and even more preferably not more than 41.

Letting the average value of the core surface hardness and the core center hardness (referred to below as the "average core hardness") be expressed as [core surface hardness+core center hardness]/2, the average core hardness, indicated in terms of the JIS-C hardness, although not subject to any particular limitation, may be set to preferably at least 35, more preferably at least 40, and even more preferably at least 50. The upper limit is preferably not more than 84, more preferably not more than 79, and even more preferably not more than 75. The above hardness range, when expressed as the Shore D hardness, is preferably at least 19, more preferably at least 22, and even more preferably at least 30. The upper limit is preferably not more than 56, more preferably not more than 52, and even more preferably not more than 49. If the average core hardness falls below the above range, the core resilience may be inadequate, as a result of which an increased distance may not be achieved, the feel on impact may become too soft, or the ball may have a poor durability to cracking on repeated impact. On the other hand, if the average core hardness exceeds the above range, the ball may have too hard a feel on full shots or the spin rate may become too high, as a result of which a good distance may not be achieved.

In the present invention, it is necessary that the core increase in hardness from the center to the surface thereof. Here, the hardness difference between the center and the surface of the core, expressed as the JIS-C hardness, is preferably at least 5, more preferably at least 8, and even more preferably at least 10. The upper limit is preferably not more than 40, more preferably not more than 35, and even more preferably not more than 25. If this difference is too small, the spin rate may become too high, as a result of which an increased distance may not be achieved. On the other hand, if the difference is too large, the durability to repeated impact may worsen or the rebound may decrease, as a result of which an increased distance may not be achieved.

The core has a deflection when subjected to compressive loading, i.e., when compressed under a final load of 1,275 N (130 kgf) from an initial load state of 98 N (10 kgf), which, while not subject to any particular limitation, is preferably at least 2.0 mm, more preferably at least 3.0 mm, and even more preferably at least 3.5 mm. The upper limit, although not subject to any particular limitation, is preferably not more than 12.0 mm, more preferably not more than 10.0 mm, and even more preferably not more than 6.0 mm. If this value is too high, the resilience of the core may become too low, resulting in an insufficient distance, the feel may become too soft, or the durability of the ball to cracking on repeated impact may worsen. On the other hand, if this value is too low, the ball may have an excessively hard feel on full shots, or the spin rate may be too high, as a result of which an increased distance may not be achieved.

A material composed primarily of rubber material I or resin material II described below may be used to form the core having the above-described surface hardness and deflection.

Rubber Material I

The rubber material is exemplified by a rubber composition which contains a base rubber and additionally includes, for example, a co-crosslinking agent, an organic peroxide, an inert filler and an organosulfur compound. Polybutadiene is preferably used as the base rubber of this rubber material.

It is desirable for the polybutadiene to have a cis-1,4 bond content on the polymer chain of at least 60 wt %, preferably at least 80 wt %, more preferably at least 90 wt %, and most preferably at least 95 wt %. Too low a cis-1,4 bond content among the bonds on the molecule may result in a lower resilience.

Also, the polybutadiene has a 1,2-vinyl bond content on the polymer chain of preferably not more than 2%, more preferably not more than 1.7%, and even more preferably not more than 1.5%. Too high a 1,2-vinyl bond content may result in a lower resilience.

To obtain a molded and vulcanized rubber composition having a good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To increase the resilience, it is preferable for the polybutadiene synthesized using the lanthanide series rare-earth compound catalyst to account for at least 10 wt %, preferably at least 20 wt %, and more preferably at least 40 wt %, of the rubber components.

Rubber components other than the above-described polybutadiene may be included in the base rubber insofar as the objects of the invention are attainable. Illustrative examples of rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The amount of unsaturated carboxylic acid and/or metal salt thereof included per 100 parts by weight of the base rubber may be set to preferably at least 2 parts by weight, more preferably at least 4 parts by weight, and even more preferably at least 6 parts by weight. The upper limit may be set to preferably not more than 60 parts by weight, more preferably not more than 45 parts by weight, even more preferably not more than 35 parts by weight, and most preferably not more than 25 parts by weight. Too much may make the core too hard, giving the ball an unpleasant feel on impact, whereas too little may lower the rebound.

The organic peroxide may be a commercially available product, suitable examples of which include Percumyl D (available from NOF Corporation), Perhexa C-40 and Perhexa 3M (both available from NOF Corporation), and Luperco 231XL (Atochem Co.). These may be used singly or as a combination of two or more thereof.

The amount of organic peroxide included per 100 parts by weight of the base rubber may be set to preferably at least 0.1 part by weight, more preferably at least 0.3 part by weight, even more preferably at least 0.5 part by weight, and most preferably at least 0.7 part by weight. The upper limit may be set to preferably not more than 5 parts by weight, more preferably not more than 4 parts by weight, even more preferably not more than 3 parts by weight, and most preferably not more than 2 parts by weight. Too much or too little organic peroxide may make it impossible to achieve a ball having a good feel, durability and rebound.

Examples of suitable inert fillers include zinc oxide, barium sulfate and calcium carbonate. These may be used singly or as a combination of two or more thereof.

The amount of inert filler included per 100 parts by weight of the base rubber may be set to preferably at least 1 part by weight, and more preferably at least 5 parts by weight. The upper limit may be set to preferably not more than 200 parts by weight, more preferably not more than 150 parts by weight, and even more preferably not more than 110 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30 (both available from Ouchi Shinko Chemical Industry Co., Ltd.), and Yoshinox 425 (Yoshitomi Pharmaceutical Industries, Ltd.). These may be used singly or as a combination of two or more thereof.

The amount of antioxidant included may be more than 0, and is set to preferably at least 0.05 part by weight, and especially at least 0.1 part by weight, per 100 parts by weight of the base rubber. The upper limit, although not subject to any particular limitation, may be set to preferably not more than 3 parts by weight, more preferably not more than 2 parts by weight, even more preferably not more than 1 part by weight, and most preferably not more than 0.5 part by weight, per 100 parts by weight of the base rubber. Too much or too little antioxidant may make it impossible to achieve a good rebound and durability.

To enhance the rebound of the golf ball and increase its initial velocity, it is preferable to include an organosulfur compound in the above base rubber. No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. The zinc salt of pentachlorothiophenol is especially preferred.

Resin Material II

Instead of the above rubber composition, a material composed primarily of a thermoplastic resin may be used as the core material. In particular, the use of an ionomer resin is preferred. More preferably, use may be made of the highly neutralized ionomer resin material having an increased degree of neutralization which is mentioned herein as the material for the subsequently described "envelope layer."

Specific examples of the thermoplastic resin include nylons, polyarylates, ionomer resins, polypropylene resins, polyurethane-type thermoplastic elastomers, and polyester-type thermoplastic elastomers. Commercial products that may be suitably used include those having the trade names Surlyn AD8512 (an ionomer resin available from E.I. DuPont de Nemours & Co.), Himilan 1706, and Himilan 1707 (both ionomer resins available from DuPont-Mitsui Polychemicals Co., Ltd.), Rilsan BMNO (a nylon resin available from Toray Industries, Inc.) and U-Polymer U-8000 (a polyarylate resin available from Unitika, Ltd.).

To obtain the above resin core, use can be made of either a forming or injection molding process, although production by an injection molding process is preferred. Suitable use may be made of a process that involves injection by an ordinary method into the cavity of a core-forming mold.

Next, the envelope layer is described.

In the present invention, as noted above, the envelope layer encasing the core is formed of two layers: an inner envelope layer and an outer envelope layer.

The inner envelope layer has a material hardness, expressed as the Shore D hardness (measured with a type D durometer in general accordance with ASTM D 2240; the same applies below), which, while not subject to any particular limitation, is preferably at least 30, more preferably at least 37, and even more preferably at least 40. The upper limit, although not subject to any particular limitation, is preferably not more than 56, more preferably not more than 53, and even more preferably not more than 50. If the inner envelope layer is too soft, the ball may have too much spin receptivity on shots with a W#1, as a result of which a good distance may not be achieved. On the other hand, if the inner envelope layer is too hard, the ball may have too hard a feel when played or the ball may have too much spin receptivity on shots with a W#1, as a result of which a good distance may not be achieved. The hardness difference between the inner envelope layer and the adjoining outer envelope layer, expressed in terms of the Shore D hardness, is preferably at least 1, and more preferably at least 2; the upper limit is preferably not more than 10, more preferably not more than 8, and even more preferably not more than 5. Outside of the above range, the ball may have too much spin receptivity on full shots, as a result of which a good distance may not be achieved. Also, the durability to cracking on repeated impact may worsen.

As used herein, "material hardness" refers to, in cases where the material is a resin, the measured hardness of a 2 mm thick sheet produced by molding the resin composition under applied pressure. In cases where the material is a rubber, the "material hardness" refers to the measured hardness of a pressed sheet having a thickness of about 2 mm produced by loading the rubber composition into a sheet-forming mold and hot molding at 170° C. for 15 minutes (the same applies below).

The inner envelope layer has a thickness which, although not subject to any particular limitation, is preferably at least 0.2 mm, more preferably at least 0.3 mm, and even more preferably at least 0.5 mm. The upper limit, although not subject to any particular limitation, is preferably not more than 2.0 mm, more preferably not more than 1.5 mm, and even more preferably not more than 1.0 mm. At an inner envelope layer thickness outside this range, the spin rate-lowering effect on shots with a driver (W#1) may be inadequate, as a result of which an increased distance may not be achieved.

The outer envelope layer has a material hardness, expressed as the Shore D hardness, which, while not subject to any particular limitation, is preferably at least 37, more preferably at least 40, and even more preferably at least 43. The upper limit, although not subject to any particular limitation, is preferably not more than 58, more preferably not more than 55, and even more preferably not more than 52. If the outer envelope layer is too soft, the ball may have too much spin receptivity on shots with a W#1, as a result of which a good distance may not be achieved. On the other hand, if the outer envelope layer is too hard, the ball may have too hard a feel when played or the ball may have too much spin receptivity on shots with a W#1, as a result of which a good distance may not be achieved. The hardness difference between the outer envelope layer and the adjoining inner intermediate layer, expressed in terms of the Shore D hardness, is preferably at least 1, more preferably at least 2, and even more preferably at least 3; the upper limit is preferably not more than 10, more preferably not more than 8, and even more preferably not more than 6. Outside of the above range, the ball may have too much spin receptivity on full shots, as a result of which a good distance may not be achieved. Also, the durability to cracking on repeated impact may worsen.

The outer envelope layer has a thickness which, although not subject to any particular limitation, is preferably at least 0.2 mm, more preferably at least 0.3 mm, and even more preferably at least 0.5 mm. The upper limit, although not subject to any particular limitation, is preferably not more than 2.0 mm, more preferably not more than 1.5 mm, and even more preferably not more than 1.0 mm. At an outer envelope layer thickness outside this range, the spin rate-lowering effect on shots with a driver (W#1) may be inadequate, as a result of which a good distance may not be achieved.

In the present invention, the envelope layer is composed of two layers—an inner envelope layer and an outer envelope layer, which respective layers may be made of the same or mutually differing resin materials. The materials which form these envelope layers may be, for example, rubber materials or resin materials, and are not subject to any particular limitation. However, in this invention, preferred use may be made of a material which includes as an essential component a base resin composed of, in admixture, specific amounts of (a) an olefin-unsaturated carboxylic acid random copolymer and/or a metal ion neutralization product of an olefin-unsaturated carboxylic acid random copolymer and (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer. In the invention, by using this material to form at least one of the envelope layers, the spin rate on shots with a driver (W#1) can be lowered, enabling a longer distance to be achieved. This material is described in detail below.

The olefin in the above base resin, whether in component (a) or component (b), has a number of carbons which is generally at least 2 but not more than 8, and preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid random copolymer of component (a) and the olefin-unsaturated carboxylic acid-unsaturated carboxylic acid ester random terpolymer of component (b) (the copolymers in components (a) and (b) are referred to collectively below as "random copolymers") can each be obtained by random copolymerization of the above components using a known method.

It is recommended that the above random copolymers have unsaturated carboxylic acid contents (acid contents) which are regulated. Here, it is recommended that the content of unsaturated carboxylic acid present in the random copolymer serving as component (a), although not subject to any particular limitation, be set to preferably at least 4 wt %, more preferably at least 6 wt %, even more preferably at least 8 wt %, and most preferably at least 10 wt %. Also, it is recommended that the upper limit, although not subject to any particular limitation, be preferably not more than 30 wt %, more preferably not more than 20 wt %, even more preferably not more than 18 wt %, and most preferably not more than 15 wt %.

Similarly, the content of unsaturated carboxylic acid present in the random copolymer serving as component (b), although not subject to any particular limitation, may be set to preferably at least 4 wt %, more preferably at least 6 wt %, and even more preferably at least 8 wt %. Also, it is recommended that the upper limit, although not subject to any particular limitation, be preferably not more than 15 wt %, more preferably not more than 12 wt %, and even more preferably not more than 10 wt %. If the acid content of the random copolymer is too low, the resilience may decrease, whereas if it is too high, the processability may decrease.

The metal ion neutralization products of the random copolymers of components (a) and (b) may be obtained by neutralizing some of the acid groups on the random copolymer with metal ions. Here, specific examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. Moreover, from the standpoint of improving resilience, the use of $Na^+$ is recommended. The degree of neutralization of the random copolymer by these metal ions is not subject to any particular limitation. Such neutralization products may be obtained by a known method. For example, use may be made of a method in which neutralization is carried out with a compound such as a formate, acetate, nitrate, carbonate, bicarbonate, oxide, hydroxide or alkoxide of the above-mentioned metal ions.

Sodium ion-neutralized ionomer resins and zinc ion-neutralized ionomer resins may be suitably used as the above metal ion neutralization products of the random copolymers to increase the melt flow rate (MFR) of the material. In this way, adjustment of the material to the subsequently described optimal melt flow rate is easy, enabling the moldability to be improved.

Commercially available products may be used as above components (a) and (b). Illustrative examples of the random copolymer in component (a) include Nucrel N1560, Nucrel N1214, Nucrel N1035 and Nucrel AN4221C (all products of DuPont-Mitsui Polychemicals Co., Ltd.), and Escor 5200, Escor 5100 and Escor 5000 (all products of ExxonMobil Chemical). Illustrative examples of the random copolymer in component (b) include Nucrel AN4311, Nucrel AN4318 and Nucrel AN4319 (all products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706, Himilan 1707 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical).

When preparing the above-described base resin, component (a) and component (b) are admixed in a weight ratio of generally between 100:0 and 0:100, preferably between 75:25 and 0:100, more preferably between 50:50 and 0:100, even more preferably between 25:75 and 0:100, and most preferably 0:100. If too little component (a) is included, the molded material obtained therefrom may have a decreased resilience.

The processability of the base resin can be further improved by, in addition to adjusting the above mixing ratio, also adjusting the mixing ratio between the random copolymers and the metal ion neutralization products of the random copolymers. In this case, it is recommended that the weight ratio of the random copolymers to the metal ion neutralization products of the random copolymers be set to generally between 100:0 and 40:60, preferably between 100:0 and 60:40, more preferably between 100:0 and 80:20, and even more preferably 100:0. The addition of too much random copolymer may lower the uniformity of the pellet composition.

A non-ionomeric thermoplastic elastomer (e) may be included in the base resin so as to enhance even further both the feel of the ball on impact and the rebound. Examples of this component (e) include olefin elastomers, styrene elastomers, polyester elastomers, urethane elastomers and polyamide elastomers. In this invention, to further increase the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

Component (e) may be included in an amount of more than 0. The upper limit in the amount included per 100 parts by weight of the base resin, although not subject to any particular limitation, is preferably not more than 50 parts by weight, more preferably not more than 40 parts by weight, even more preferably not more than 30 parts by weight, and most preferably not more than 20 parts by weight. Too much component (e) may lower the compatibility of the mixture, possibly resulting in a substantial decline in the durability of the golf ball.

Next, a fatty acid or fatty acid derivative having a molecular weight of at least 228 but not more than 1500 may be added as component (c) to the base resin. Compared with the base resin, this component (c) has a very low molecular weight and, by suitably adjusting the melt viscosity of the mixture, helps in particular to improve the flow properties. Moreover, component (c) includes a relatively high content of acid groups (or derivatives thereof), and is capable of suppressing an excessive loss of resilience.

The molecular weight of the fatty acid or fatty acid derivative of component (c) may be set to at least 228, preferably at least 256, more preferably at least 280, and even more preferably at least 300. The upper limit may be set to not more than 1500, preferably not more than 1000, more preferably not more than 600, and even more preferably not more than 500. If the molecular weight is too low, the heat resistance cannot be improved. On the other hand, if the molecular weight is too high, the flow properties cannot be improved.

Preferred use as the fatty acid or fatty acid derivative of component (c) may likewise be made of, for example, an unsaturated fatty acid (or derivative thereof) containing a double bond or triple bond on the alkyl moiety, or a saturated fatty acid (or derivative thereof) in which the bonds on the alkyl moiety are all single bonds. In either case, it is recommended that the number of carbons on the molecule be preferably at least 18, more preferably at least 20, even more preferably at least 22, and most preferably at least 24. It is recommended that the upper limit be preferably not more than 80, more preferably not more than 60, even more preferably not more than 40, and most preferably not more than 30. Too few carbons may make it impossible to improve the heat resistance and may also make the acid group content so high as to diminish the flow-improving effect on account of interactions with acid groups present in the base resin. On the other hand, too many carbons increases the molecular weight, which may keep a distinct flow-improving effect from appearing.

Specific examples of the fatty acid of component (c) include myristic acid, palmitic acid, stearic acid, 12-hydroxystearic acid, behenic acid, oleic acid, linoleic acid, linolenic acid, arachidic acid and lignoceric acid. Preferred use may be made of stearic acid, arachidic acid, behenic acid and lignoceric acid in particular.

The fatty acid derivative of component (c) is exemplified by metallic soaps in which the proton on the acid group of the fatty acid has been replaced with a metal ion. Examples of the metal ion include $Na^{+}$, $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Use may also be made of known metallic soap-modified ionomers (see, for example, U.S. Pat. No. 5,312,857, U.S. Pat. No. 5,306,760 and International Disclosure WO 98/46671) when using above-described components (a) and/or (b), and component (c).

The amount of component (c) included per 100 parts by weight of the resin component when above components (a), (b) and (e) have been suitably mixed may be set to at least 5 parts by weight, preferably at least 10 parts by weight, more preferably at least 20 parts by weight, and even more preferably at least 30 parts by weight. The upper limit in the amount included may be set to not more than 120 parts by weight, preferably not more than 115 parts by weight, more preferably not more than 110 parts by weight, and even more preferably not more than 100 parts by weight. If the amount of component (c) included is too small, the melt viscosity may decrease, lowering the processability. On the other hand, if the amount included is too large, the durability may decrease.

A basic inorganic metal compound capable of neutralizing acid groups in the base resin and in component (c) may be added as component (d). In cases where this component (d) is not included and a metal soap-modified ionomer resin (e.g., any of the metal soap-modified ionomer resins cited in the above-mentioned patent publications) is used alone, the metallic soap and un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, if the fatty acid deposits on the surface of the molded material, it may substantially lower paint film adhesion or have other undesirable effects such as lowering the resilience of the resulting molded material.

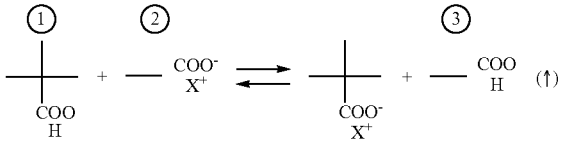

(1) un-neutralized acid group present on the ionomer resin
(2) metallic soap
(3) fatty acid
X: metal cation To solve this problem, component (d), a basic inorganic metal compound which neutralizes the acid groups present in the base resin and component (c), is included as an essential component. By including component (d), the acid groups in the base resin and component (c) are neutralized. Moreover, synergistic effects from the blending of these respective components confer the resin composition with a number of excellent properties; namely, the resin composition has a higher thermal stability and at the same time is imparted with a good moldability, and the resilience as a golf ball-forming material is enhanced.

Illustrative examples of the metal ions used here in the basic inorganic metal compound include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are more preferred. Magnesium oxide is especially preferred.

The amount of component (d) included per 100 parts by weight of the resin component may be set to at least 0.1 part by weight, preferably at least 0.5 part by weight, more preferably at least 1 part by weight, and even more preferably at least 1.2 parts by weight. The upper limit in the amount included may be set to not more than 17 parts by weight, preferably not more than 15 parts by weight, more preferably not more than 10 parts by weight, and even more preferably not more than 5 parts by weight. Too little component (d) may fail to improve thermal stability and resilience, whereas too much may instead lower the heat resistance of the golf ball-forming material due to the presence of excess basic inorganic metal compound.

By blending specific respective amounts of components (c) and (d) with the resin component, i.e., the base resin containing specific respective amounts of components (a) and (b) in admixture with optional component (e), a material having excellent thermal stability, flow properties and moldability can be obtained, in addition to which the resilience of moldings obtained therefrom can be markedly improved.

It is recommended that the material formulated from specific amounts of the above-described resin component and components (c) and (d) have a high degree of neutralization (i.e., that the material be highly neutralized). Specifically, it is recommended that at least 50 mol %, preferably at least 60 mol %, more preferably at least 70 mol %, and even more preferably at least 80 mol %, of the acid groups in the material be neutralized. Highly neutralizing the acid groups in the material makes it possible to more reliably suppress the exchange reactions that cause trouble when only a base resin and a fatty acid or fatty acid derivative are used as in the above-cited prior art, thus preventing the generation of fatty acid. As a result, the thermal stability is substantially improved and the processability is good, making it possible to obtain molded products of much better resilience than prior-art ionomer resins.

"Degree of neutralization," as used here, refers to the degree of neutralization of acid groups present within the mixture of the base resin and the fatty acid or fatty acid derivative serving as component (c), and differs from the degree of neutralization of the ionomer resin itself when an ionomer resin is used as the metal ion neutralization product of a random copolymer in the base resin. When a mixture of the invention having a certain degree of neutralization is compared with an ionomer resin alone having the same degree of neutralization, because the material of the invention contains a very large number of metal ions owing to the inclusion of component (d), the density of ionic crosslinks which contribute to improved resilience is increased, making it possible to confer the molded product with an excellent resilience.

The resin material should preferably have a melt flow rate (MFR) adjusted within a specific range in order to ensure flow properties that are particularly suitable for injection molding, and thus improve moldability. In this case, it is recommended that the melt flow rate, as measured in general accordance with JIS-K7210 at a temperature of 190° C. and under a load of 21.18 N (2.16 kgf), be adjusted to preferably at least 0.6 g/10 min, more preferably at least 0.7 g/10 min, even more preferably at least 0.8 g/10 min, and most preferably at least 2 g/10 min. It is recommended that the upper limit be adjusted to preferably not more than 20 g/10 min, more preferably not more than 10 g/10 min, even more preferably not more than 5 g/10 min, and most preferably not more than 3 g/10 min. Too high or low a melt flow rate may result in a substantial decline in processability.

Commercial products may be used as the envelope layer-forming materials. Specific examples include those having the trade names HPF 1000, HPF 2000, HPF AD1027, HPF AD1035 and HPF AD1040, as well as the experimental material HPF SEP1264-3, all produced by E.I. DuPont de Nemours & Co.

Next, the intermediate layer is described.

In the present invention, as mentioned above, the intermediate layer is composed of two layers: an inner intermediate layer and an outer intermediate layer.

The inner intermediate layer has a material hardness, expressed as the Shore D hardness, which, while not subject to any particular limitation, is preferably at least 40, more preferably at least 43, and even more preferably at least 46. The upper limit, although not subject to any particular limitation, is preferably not more than 60, more preferably not more than 58, and even more preferably not more than 55. If the inner intermediate layer is too soft, the ball may have excessive spin receptivity on shots with a W#1, as a result of which a good distance may not be achieved. On the other hand, if the inner intermediate layer is too hard, the ball may have too hard a feel when played or the ball may have too much spin receptivity on shots with a W#1, as a result of which a good distance may not be achieved. The hardness difference between the inner intermediate layer and the adjoining outer intermediate layer, expressed in terms of the Shore D hardness, is preferably at least 1, more preferably at least 2, and even more preferably at least 3; the upper limit is preferably not more than 10, more preferably not more than 8, and even more preferably not more than 6. Outside of the above range, the ball may have too much spin receptivity on full shots, as a result of which a good distance may not be achieved. Also, the durability to cracking on repeated impact may worsen.

The inner intermediate layer has a thickness which, although not subject to any particular limitation, is preferably at least 0.2 mm, more preferably at least 0.3 mm, and even more preferably at least 0.5 mm. The upper limit, although not subject to any particular limitation, is preferably not more than 2.0 mm, more preferably not more than 1.5 mm, and even more preferably not more than 1.0 mm. At an inner envelope layer thickness outside of this range, the spin rate-lowering effect on shots with a driver (W#1) may be inadequate, as a result of which an increased distance may not be achieved.

The outer intermediate layer has a material hardness, expressed as the Shore D hardness, which, while not subject to any particular limitation, is preferably at least 44, more preferably at least 47, and even more preferably at least 50. The upper limit, although not subject to any particular limitation, is preferably not more than 65, more preferably not more than 61, and even more preferably not more than 58. If this layer is too much softer than the above range, the ball may have excessive spin receptivity on shots with a W#1, as a result of which a good distance may not be achieved. If this layer is too much harder than the above range, the ball may have too hard a feel when played or the ball may have too much spin receptivity on shots with a W#1, as a result of which a good distance may not be achieved. The hardness difference between the outer intermediate layer and the adjoining outer layer, expressed in terms of the Shore D hardness, is preferably at least 3, more preferably at least 5, and even more preferably at least 8; the upper limit is preferably not more than 20, more preferably not more than 15, and even more preferably not more than 12. If this hardness difference is outside of the above range, the ball may have too much spin receptivity on full shots, as a result of which a good distance may not be achieved. Also, the durability to cracking on repeated impact may worsen.

The outer intermediate layer has a thickness which, although not subject to any particular limitation, is preferably at least 0.2 mm, more preferably at least 0.3 mm, and even more preferably at least 0.5 mm. The upper limit, although not subject to any particular limitation, is preferably not more than 2.0 mm, more preferably not more than 1.5 mm, and even more preferably not more than 1.0 mm. At an outer intermediate layer thickness outside this range, the spin rate-lowering effect on shots with a driver (W#1) may be inadequate, as a result of which a good distance may not be achieved.

No particular limitation is imposed on the resin material which may be used in the outer and inner intermediate layers, although it is suitable to employ the above-described envelope layer materials.

Commonly used additives, such as pigments, fillers for adjusting the specific gravity, dispersants, antioxidants, ultraviolet absorbers and light stabilizers, may be suitably added and blended into the above intermediate layer-forming materials.

Next, the outer layer is described. As used herein, the term "outer layer" denotes the cover layer positioned on the outermost side within the ball construction, and excludes what are referred to herein as the intermediate layer and the envelope layer.

The outer layer has a material hardness, expressed as the Shore D hardness, which, while not subject to any particular limitation, may be set to preferably at least 55, more preferably at least 60, and even more preferably at least 63. The upper limit, although not subject to any particular limitation, may be set to preferably not more than 75, more preferably not more than 70, and even more preferably not more than 68. If the material hardness of the outer layer is lower than the above range, the ball may have too much spin receptivity on full shots, as a result of which a good distance may not be achieved. On the other hand, if the material hardness of the outer layer is higher than the above range, the durability of the ball to cracking on repeated impact may worsen or the ball may have too hard a feel when played with a putter and on short approach shots.

The outer layer has a thickness which, while not subject to any particular limitation, may be set to preferably at least 0.5 mm, more preferably at least 0.9 mm, and even more preferably at least 1.0 mm. The upper limit, although not subject to any particular limitation, may be set to preferably not more than 2.5 mm, more preferably not more than 2.0 mm, and even more preferably not more than 1.4 mm. If the outer layer is thicker than the above range, the ball may have an inadequate rebound on shots with a driver (W#1) or the spin rate may be too high, as a result of which an increased distance may not be achieved. On the other hand, if the outer layer is thinner than the above range, the ball may have a poor scuff resistance or may have inadequate controllability even when played by a professional or other skilled golfer.

The outer layer may be formed to a thickness similar to that of the adjoining outer intermediate layer, although it is preferable for the outer layer to be formed so as to be thicker than the adjoining outer intermediate layer by an amount within a range of up to 1.0 mm. If the outer layer is too much thinner than the outer intermediate layer, the durability of the ball to cracking on repeated impact may worsen, or the spin rate-lowering effect on shots with a W#1 may be inadequate, as a result of which a good distance may not be achieved. On the other hand, if the outer layer is too much thicker than the outer intermediate layer, the feel on impact may be too hard or the spin rate-lowering effect on shots with a W#1 may be inadequate, as a result of which a good distance may not be achieved.

The material used in the outer layer of the present invention is not subject to any particular limitation. However, the use of ionomer resin is most preferred on account of their high rigidity and high resilience. Such ionomer resins are exemplified by, in particular, ionomer resins in which some of the carboxylic acid in a copolymer of an α-olefin and an α,β-unsaturated carboxylic acid of 3 to 8 carbons is neutralized with metal ions, ionomer resins in which some of the carboxylic acids in a terpolymer of an α-olefin, an α,β-unsaturated carboxylic acid of 3 to 8 carbons and an α,β-unsaturated carboxylic acid ester are neutralized with metal ions, and mixtures thereof. The α-olefin in the ionomer resin is preferably ethylene or propylene. Examples of the α,β-unsaturated carboxylic acid include acrylic acid, methacrylic acid, fumaric acid, maleic acid and crotonic acid, with acrylic acid and methacrylic acid being especially preferred. Examples of the α,β-unsaturated carboxylic acid ester include the methyl, ethyl, propyl, n-butyl and isobutyl esters of acrylic acid, methacrylic acid, fumaric acid and maleic acid. Acrylic acid esters and methacrylic acid esters are especially preferred. Examples of neutralizing metal ions include alkali metal ions, such as sodium ions, potassium ions and lithium ions; divalent metal ions, such as zinc ions, calcium ions and magnesium ions; trivalent metal ions, such as aluminum ions and neodymium ions; and mixtures thereof. Of these, from the standpoint of rebound, durability and the like, preferred use may be made of, for example, sodium ions, zinc ions and lithium ions. The outer layer ionomer is preferably composed of a high acid (i.e., having an acid content of at least 16 wt %) ionomer resin, or a high acid ionomer mixture. A mixture of two or more high acid (i.e., having an acid content of at least 16 wt %) ionomer resins neutralized in various degrees with different metal ions is even more preferred.

Commonly used additives, such as pigments, fillers for adjusting the specific gravity, dispersants, antioxidants, ultraviolet absorbers and light stabilizers, may be suitably added and blended in preparing the above outer layer-forming ionomer.

Total Thickness of Inner Layers (Outer Intermediate Layer Thickness+Inner Intermediate Layer Thickness+Outer Envelope Layer Thickness+Inner Envelope Layer Thickness)

Of the cover layers which encase the core, the total thickness of those cover layers exclusive of the outer layer (which layers are referred to below as simply "the inner layers") is preferably at least 1.0 mm, more preferably at least 1.5 mm, and even more preferably at least 2.0 mm. The upper limit is preferably not more than 10.0 mm, more preferably not more than 5.0 mm, and even more preferably not more than 4.0 mm. At a total thickness for the inner layers outside of the above range, the spin rate-lowering effect on shots with a W#1 may be inadequate, as a result of which a good distance may not be achieved.

Balance Among Outer Layer Hardness, Intermediate Layer Hardness, Envelope Layer Hardness, Average Core Hardness and Core Center Hardness In this invention, letting the average hardness of the core be expressed by the following formula:

average core hardness (Shore *D*)=[core surface hardness (Shore *D*)+core center hardness (Shore *D*)]/2, it is critical for the outer layer hardness (Shore D) to be higher than the average core hardness and for each of the envelope layers and the intermediate layers to be softer than the outer layer.

The difference between the outer layer hardness and the average core hardness, expressed in terms of the Shore hardness, is preferably at least 5, more preferably at least 10, and even more preferably at least 15. The upper limit is preferably not more than 40, more preferably not more than 35, and even more preferably not more than 30. Outside of the above range, the reduction in the spin rate on shots with a W#1 may be inadequate, as a result of which a good distance may not be achieved, or the feel of the ball on shots with a W#1 may become too hard.

Also, although not subject to any particular limitation, in the present invention, it is preferable for the Shore D hardness relationship among the envelope layers, intermediate layers and outer layer to satisfy the following conditions:

outer layer hardness>outer intermediate layer hardness>inner intermediate layer hardness>outer envelope layer hardness>inner envelope layer hardness.

The Shore D hardness relationship more preferably satisfies the following conditions:

outer layer hardness>outer intermediate layer hardness>inner intermediate layer hardness>outer envelope layer hardness>inner envelope layer hardness>core center hardness, and most preferably satisfies the following conditions:

outer layer hardness>outer intermediate layer hardness>inner intermediate layer hardness>outer envelope layer hardness>inner envelope layer hardness average core hardness>core center hardness.

Outside of the above hardness relationship, the spin rate on shots with a W#1 may become too high, as a result of which a good distance may not be achieved.

Relationship Among Outer Layer Thickness, Intermediate Layer Thicknesses, Envelope Layer Thicknesses and Core Diameter Although not subject to any particular limitation, it is preferable for the outer intermediate layer, inner intermediate layer, outer envelope layer and inner envelope layer to each have a thickness which is similar to or less than that of the outer layer.

In addition, the value expressed as (outer intermediate layer thickness+inner intermediate layer thickness)/outer layer thickness is preferably at least 0.75, more preferably at least 0.8, and even more preferably at least 0.9. The upper limit is preferably not more than 1.5, more preferably not more than 1.3, and even more preferably not more than 1.1. Outside of the above thickness relationship, the spin rate on shots with a W#1 may become too high, as a result of which a good distance may not be achieved.

Also, the value expressed as (outer envelope layer thickness+inner envelope layer thickness)/outer layer thickness is preferably at least 0.75, more preferably at least 0.8, and even more preferably at least 0.9. The upper limit is preferably not more than 1.5, more preferably not more than 1.3, and even more preferably not more than 1.1. Outside of the above thickness relationship, the spin rate on shots with a W#1 may become too high, as a result of which a good distance may not be achieved.

Moreover, the value expressed as (outer intermediate layer thickness+inner intermediate layer thickness)/(outer envelope layer thickness+inner envelope layer thickness) is preferably at least 0.75, more preferably at least 0.8, and even more preferably at least 0.9. The upper limit is preferably not more than 1.5, more preferably not more than 1.3, and even more preferably not more than 1.1. Outside of the above thickness relationship, the spin rate on shots with a W#1 may become too high, as a result of which a good distance may not be achieved.

Also, it is preferable for the following relationship to be satisfied:

outer layer thickness≤(outer intermediate layer thickness+inner intermediate layer thickness+outer envelope layer thickness+inner envelope layer thickness)<core diameter.

Outside of the above thickness relationship, the spin rate on shots with a W#1 may become too high, as a result of which a good distance may not be achieved.

Multi-piece solid golf balls having the above-described core, envelope layers, intermediate layers and outer layer can be manufactured by a known process such as injection molding. More specifically, a multi-piece solid golf ball having a construction of six or more layers can be obtained by using press molding or injection molding to fabricate a core composed primarily of a rubber material, using specific injection molds to successively form envelope layers and intermediate layers around the core, then injection-molding an outer layer material over the resulting intermediate layer-encased sphere. Alternatively, another method may be used to form the outer layer in which a pair of half-cups are molded beforehand using the above-described outer layer material, the intermediate layer-encased sphere is enclosed in these half-cups, and molding under applied pressure is carried out at from 120 to 170° C. for 1 to 5 minutes.

In the golf ball of the invention, to further improve the aerodynamic properties and thereby increase the distance traveled by the ball, as in conventional golf balls, it is desirable to form a plurality of dimples on the surface of the ball. By optimizing dimple parameters, such as the types and total number of dimples, owing to synergistic effects with the above-described ball construction, the trajectory is more stable, making it possible to obtain a golf ball having an excellent distance performance. Moreover, the ball surface may be subjected to various types of treatment, such as surface preparation, stamping and painting, in order to enhance the design and durability of the golf ball.

First, the total number of dimples, although not subject to any particular limitation, may be set to preferably at least 280, more preferably at least 300, and even more preferably at least 320. The upper limit may be set to preferably not more than 360, more preferably not more than 350, and even more preferably not more than 340. If the number of dimples is higher than the above range, the ball trajectory may become lower, possibly decreasing the distance traveled by the ball. On the other hand, if the number of dimples is lower than the above range, the ball trajectory may become higher, as a result of which an increased distance may not be achieved.

The shapes of the dimples are not limited to circular shapes; one or more type from among, for example, various polygonal shapes, dewdrop shapes and oval shapes may be suitably selected. In cases where, for example, circular dimples are used, the diameter of the dimples may be set to at least about 2.5 mm but not more than about 6.5 mm, and the depth may be set to at least 0.08 mm but not more than 0.30 mm.

To fully manifest the aerodynamic characteristics of the dimples, the dimple coverage on the spherical surface of the golf ball, which is the sum of the individual dimple surface areas, each defined by the border of the flat plane circumscribed by the edge of a dimple, expressed as a ratio (SR) with respect to the spherical surface area of the ball were it to be free of dimples, is preferably at least 60% but not more than 90%. Also, to optimize the trajectory of the ball, the value $V_0$ obtained by dividing the spatial volume of each dimple below the flat plane circumscribed by the edge of that dimple by the volume of a cylinder whose base is the flat plane and whose height is the maximum depth of the dimple from the base is preferably at least 0.35 but not more than 0.80. In addition, the VR value, which is the sum of the volumes of the individual dimples formed below the flat plane circumscribed by the edge of the dimple, as a percentage of the volume of the ball sphere were it to have no dimples thereon, is preferably at least 0.6% but not more than 1.0%. Outside the above ranges for these values, the ball may assume a trajectory that is not conducive to achieving a good distance, as a result of which the ball may fail to travel a sufficient distance when played.

The golf ball of the invention, which can be manufactured so as to conform with the Rules of Golf for competitive play, may be produced to a ball diameter which is of a size that will not pass through a ring having an inside diameter of 42.672 mm, but is not more than 42.80 mm, and to a weight of generally from 45.0 to 45.93 g.

As shown above, by having the core composed of an elastomer, by forming the envelope of two layers—an inner envelope layer and an outer envelope layer, by forming the intermediate layer of two layers—an inner intermediate layer and an outer intermediate layer, and by optimizing the respective thicknesses and hardnesses of the core, the envelope layers, the intermediate layers and the outer layer as described above, the spin rate of the ball on full shots with a driver can be lowered, enabling both a further increase in the distance traveled by the ball and also a good feel on impact to be achieved. The golf ball of the invention is especially useful as a golf ball for ordinary amateur golfers who do not have a very high head speed.

EXAMPLES

Examples of the invention and Comparative Examples are given below by way of illustration, and not by way of limitation.

Examples 1 to 3, Comparative Examples 1 to 5

Formation of Core

Rubber compositions were formulated as shown in Table 1, then molded and vulcanized at 156° C. for 15 minutes to form cores.

TABLE 1

| | | Example | | | Comparative Example | | | | |
|---|---|---|---|---|---|---|---|---|---|
| | | 1 | 2 | 3 | 1 | 2 | 3 | 4 | 5 |
| Core formulation | Polybutadiene A | 70 | 70 | 70 | 70 | 70 | 70 | 70 | 70 |
| | Polybutadiene B | 20 | 20 | 20 | 20 | 20 | 20 | 20 | 20 |
| | Polyisoprene rubber | 10 | 10 | 10 | 10 | 10 | 10 | 10 | 10 |
| | Zinc acrylate | 24.2 | 22.1 | 19.9 | 24.2 | 32.6 | 36.1 | 24.2 | 24.2 |
| | Peroxide | 1.2 | 1.2 | 1.2 | 1.2 | 1.2 | 1.2 | 1.2 | 1.2 |
| | Antioxidant | 0.1 | 0.1 | 0.1 | 0.1 | 0.1 | 0.1 | 0.1 | 0.1 |
| | Zinc oxide | 35.4 | 36.1 | 36.9 | 35.4 | 32.4 | 31.1 | 35.4 | 35.9 |

Details on the materials in Table 1 are given below.

Polybutadiene A: Available under the trade name "BR 730" from JSR Corporation.

Polybutadiene B: Available under the trade name "BR 51" from JSR Corporation.

Polybutadiene Rubber: Available under the trade name "IR 2200" from JSR Corporation.

Peroxide: A mixture of 1,1-di(t-butylperoxy)-cyclohexane and silica, available under the trade name "Perhexa C-40" from NOF Corporation.

Antioxidant: 2,2'-Methylenebis(4-methyl-6-t-butylphenol), available under the trade name "Nocrac NS-6" from Ouchi Shinko Chemical Industry Co., Ltd.

Formation of Envelope Layers, Intermediate Layers and Outer Layer

Figure 2:
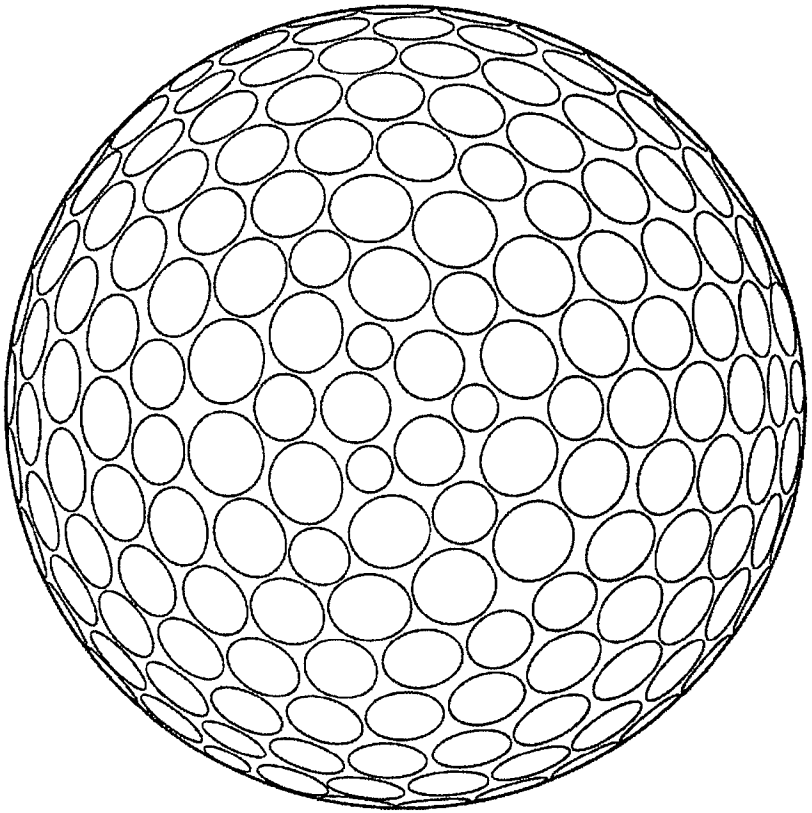
FIG. 2 is a top view showing the dimple pattern used on the balls in the examples of the invention.

Next, an inner envelope layer, an outer envelope layer, an inner intermediate layer, an outer intermediate layer and an outer layer formulated as shown in Table 2 were successively injection-molded over the core obtained above, thereby producing a multi-piece solid golf ball having a six-layer construction in which five cover layers are formed over the core. At this time, the dimples shown in FIG. 2 were formed on the surface of the outer layer. Details on the dimples are given in Table 3.

TABLE 2

| Formulation (pbw) | No. 1 | No. 2 | No. 3 | No. 4 | No. 5 | No. 6 | No. 7 | No. 8 | No. 9 |
|---|---|---|---|---|---|---|---|---|---|
| Himilan 1601 | | | | | | | | | 50 |
| Himilan 1557 | | | | | | 30 | | | 50 |
| Himilan 1855 | | | | | | 20 | | | |
| AM7317 | 25 | | | | | | | | |
| AM7318 | 50 | | | | | | | | |
| AM7329 | 25 | | | | | | | | |
| AM7331 | | | | | | 50 | | | |
| Surlyn 7930 | | | | | | | 37 | | |
| Surlyn 6320 | | | | | | | 35.5 | | |
| AN4319 | | 30 | | 100 | | | | 50 | |
| AN4318 | | | | | | | 27.5 | | |
| AN4221C | | 60 | | | | | | | |
| HPF1000 | | | 100 | | | | | 50 | |
| HPF2000 | | | | | 100 | | | | |
| Dynaron 6100P | | 10 | | | | | | | |
| Polyethylene wax | 1 | | | | | | | | |
| Magnesium stearate | 1.7 | 60 | | 100 | | 1.0 | 1.1 | 50 | 0.6 |
| Magnesium oxide | | 1.3 | | 2.8 | | | | 1.4 | |
| Titanium oxide | 2.8 | | | | | 2.2 | 3.2 | | 2.4 |

Details on the materials in Table 2 are given below.

Himilan: Ionomer resins available from DuPont-Mitsui Polychemicals Co., Ltd.

AM7317, AM7318: High acid content ionomers available from DuPont-Mitsui Polychemicals Co., Ltd.

AM7329, AM7331: Ionomers available from DuPont-Mitsui Polychemicals Co., Ltd.

AN4319, AN4318, AN4221C: Available under the trade name "Nucrel" from DuPont-Mitsui Polychemicals Co., Ltd.

HPF1000, HPF2000: HPF polymers available from E.I. DuPont de Nemours & Co.

Dynaron 6100P: A hydrogenated polymer available from JSR Corporation.

Polyethylene wax: A low-molecular-weight polyethylene wax available under the trade name "Sanwax 161P" from Sanyo Chemical Industries, Ltd.

Magnesium oxide: Available under the trade name "Kyowamag MF150" from Kyowa Chemical Industry Co., Ltd.

TABLE 3

| No. | Number of dimples | Diameter (mm) | Depth (mm) | $V_0$ | SR | VR |
|---|---|---|---|---|---|---|
| 1 | 12 | 4.6 | 0.15 | 0.47 | 81 | 78 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of a dimple, as a percentage of surface area of ball sphere were it to have no dimples thereon (units: %).

VR: Sum of volumes of individual dimples formed below flat plane circumscribed by the edge of the dimple, as a percentage of volume of ball sphere were it to have no dimples thereon (units: %).

The various golf balls obtained were tested and evaluated by the methods described below with regard to properties of the various layers, such as thickness, hardness and deflection, and also flight performance and feel. The results are shown in Tables 4 and 5. All measurements were carried out in a 23° C. atmosphere.

(1) Core Deflection (mm)

The core was placed on a hard plate, and the amount of deformation by the core when compressed under a final load of 1,275 N (130 kgf) from an initial load state of 98 N (10 kgf) was measured.

(2) Core Surface Hardness

The durometer indenter was set substantially perpendicular to the spherical surface of the core, and JIS-C hardness measurements (in accordance with JIS-K6301) were taken at two randomly selected points on the core surface. The average of the two measurements was used as the core surface hardness. In addition, the Shore D hardness of the core surface was measured by the same method as just described, but using a type D durometer in accordance with ASTM-2240.

(3) Core Center Hardness

The core was cut into half, creating a flat plane. The durometer indenter was set substantially perpendicular at the center thereof, and the JIS-C hardness was measured (in accordance with JIS-K6301). In addition, the Shore D hardness of the core center was measured by the same method as just described, but using a type D durometer in accordance with ASTM-2240.

(4) Average Core Hardness

Average core hardness=(core surface hardness+core center hardness)/2

(5) Material Hardnesses of Envelope Layers, Intermediate Layers and Outer Layer (Hardnesses of Molded Sheets)

The respective layer-forming materials were molded into sheets having a thickness of about 2 mm and held for two weeks at 23° C., following which the Shore D hardnesses were measured with a type D durometer in accordance with ASTM D-2240.

(6) Flight Performance on Shots with Driver

The distance traveled by the ball when hit at a head speed (HS) of 40 m/s with a driver (abbreviated below as "W#1"; TourStage GR (2010 model), manufactured by Bridgestone Sports Co., Ltd.; loft angle, 10.5°) mounted on a golf swing robot was measured. The results were rated according to the criteria shown below. The spin rate was the value measured for the ball, using an apparatus for measuring initial conditions, immediately after the ball was hit in the same way as described above.

Good: Total distance was 204 m or more

NG: Total distance was less than 204 m (7) Feel

Amateur golfers who value distance and have a head speed (HS) of 35 to 45 m/s carried out sensory tests on the ball when hit with a driver (W#1). The results were rated as follows.

Good: The ball had a good, soft feel

NG: The ball had a hard feel

TABLE 4

| | | | Example | | | Comparative Example | | | | |
|---|---|---|---|---|---|---|---|---|---|---|
| | | | 1 | 2 | 3 | 1 | 2 | 3 | 4 | 5 |
| Core | Diameter (mm) | | 35.5 | 35.5 | 35.5 | 35.5 | 35.5 | 35.5 | 35.5 | 35.5 |
| | Weight (g) | | 29.0 | 29.0 | 29.0 | 29.0 | 29.0 | 29.0 | 29.0 | 29.1 |
| | Deflection (mm) | | 3.7 | 4.4 | 5.2 | 3.7 | 2.5 | 2.0 | 3.7 | 3.7 |
| | Surface hardness | Shore D | 54 | 51 | 47 | 54 | 60 | 62 | 54 | 54 |
| | | JIS-C | 81 | 77 | 73 | 81 | 89 | 92 | 81 | 81 |
| | Center hardness | Shore D | 38 | 37 | 35 | 38 | 44 | 44 | 38 | 38 |
| | | JIS-C | 61 | 59 | 57 | 61 | 68 | 69 | 61 | 61 |
| | Average core hardness | Shore D | 46 | 44 | 41 | 46 | 52 | 53 | 46 | 46 |
| | | JIS-C | 71 | 68 | 65 | 71 | 79 | 81 | 71 | 71 |
| | Surface − Center | Shore D | 15 | 14 | 12 | 15 | 16 | 17 | 15 | 15 |
| | | JIS-C | 20 | 18 | 16 | 20 | 21 | 23 | 20 | 20 |
| Inner envelope layer | Material (type) | | No. 5 | No. 5 | No. 5 | No. 5 | No. 5 | No. 5 | — | — |
| | Thickness (mm) | | 0.6 | 0.6 | 0.6 | 0.6 | 0.6 | 0.6 | — | — |
| | Specific gravity (g/cm$^3$) | | 0.96 | 0.96 | 0.96 | 0.96 | 0.96 | 0.96 | — | — |
| | Sheet (Shore D) | | 46 | 46 | 46 | 46 | 46 | 46 | — | — |
| Inner envelope layer-encased sphere | Diameter (mm) | | 36.7 | 36.7 | 36.7 | 36.7 | 36.7 | 36.7 | — | — |
| | Weight (g) | | 31.4 | 31.4 | 31.4 | 31.4 | 31.4 | 31.4 | — | — |
| Outer envelope layer | Material (type) | | No. 4 | No. 4 | No. 4 | No. 4 | No. 4 | No. 4 | No. 4 | No. 4 |
| | Thickness (mm) | | 0.6 | 0.6 | 0.6 | 0.6 | 0.6 | 0.6 | 1.2 | 1.2 |
| | Specific gravity (g/cm$^3$) | | 0.95 | 0.95 | 0.95 | 0.95 | 0.95 | 0.95 | 0.95 | 0.95 |
| | Sheet (Shore D) | | 48 | 48 | 48 | 48 | 48 | 48 | 48 | 48 |
| Outer envelope layer-encased sphere | Diameter (mm) | | 37.9 | 37.9 | 37.9 | 37.9 | 37.9 | 37.9 | 37.9 | 37.9 |
| | Weight (g) | | 33.8 | 33.8 | 33.8 | 33.8 | 33.8 | 33.8 | 33.8 | 33.9 |
| Inner intermediate layer | Material (type) | | No. 3 | No. 3 | No. 3 | No. 3 | No. 3 | No. 8 | No. 3 | — |
| | Thickness (mm) | | 0.6 | 0.6 | 0.6 | 0.6 | 0.6 | 0.6 | 0.6 | — |
| | Specific gravity (g/cm$^3$) | | 0.96 | 0.96 | 0.96 | 0.96 | 0.96 | 0.96 | 0.96 | — |
| | Sheet (Shore D) | | 51 | 51 | 51 | 51 | 51 | 50 | 51 | — |
| Inner intermediate layer-encased sphere | Diameter (mm) | | 39.1 | 39.1 | 39.1 | 39.1 | 39.1 | 39.1 | 39.1 | — |
| | Weight (g) | | 36.5 | 36.5 | 36.5 | 36.5 | 36.5 | 36.5 | 36.5 | — |
| Outer intermediate layer | Material (type) | | No. 2 | No. 2 | No. 2 | No. 2 | No. 2 | No. 3 | No. 2 | No. 2 |
| | Thickness (mm) | | 0.6 | 0.6 | 0.6 | 0.6 | 0.6 | 0.6 | 0.6 | 1.2 |
| | Specific gravity (g/cm$^3$) | | 0.95 | 0.95 | 0.95 | 0.95 | 0.95 | 0.96 | 0.95 | 0.95 |
| | Sheet (Shore D) | | 55 | 55 | 55 | 55 | 55 | 51 | 55 | 55 |
| Outer intermediate layer-encased sphere | Diameter (mm) | | 40.3 | 40.3 | 40.3 | 40.3 | 40.3 | 40.3 | 40.3 | 40.3 |
| | Weight (g) | | 39.4 | 39.4 | 39.4 | 39.4 | 39.4 | 39.4 | 39.4 | 39.4 |
| Outer layer material | Material (type) | | No. 1 | No. 1 | No. 1 | No. 6 | No. 7 | No. 6 | No. 9 | No. 9 |
| | Thickness (mm) | | 1.2 | 1.2 | 1.2 | 1.2 | 1.2 | 1.2 | 1.2 | 1.2 |
| | Specific gravity (g/cm$^3$) | | 0.97 | 0.97 | 0.97 | 0.97 | 0.97 | 0.97 | 0.97 | 0.97 |
| | Sheet (Shore D) | | 65 | 65 | 65 | 53 | 50 | 53 | 60 | 60 |
| Ball | Diameter (mm) | | 42.7 | 42.7 | 42.7 | 42.7 | 42.7 | 42.7 | 42.7 | 42.7 |
| | Weight (g) | | 45.5 | 45.5 | 45.5 | 45.5 | 45.5 | 45.5 | 45.5 | 45.5 |
| | Outer layer hardness - | | 10 | 10 | 10 | −2 | −5 | 2 | 5 | 5 |

TABLE 4-continued

| | | Example | | | Comparative Example | | | | |
|---|---|---|---|---|---|---|---|---|---|
| | | 1 | 2 | 3 | 1 | 2 | 3 | 4 | 5 |
| | Outer intermediate layer hardness (Shore D) | | | | | | | | |
| | Outer layer hardness - Average core hardness (Shore D) | 19 | 21 | 24 | 7 | −2 | 0 | 14 | 14 |

TABLE 5

| | | Example | | | Comparative Example | | | | |
|---|---|---|---|---|---|---|---|---|---|
| | | 1 | 2 | 3 | 1 | 2 | 3 | 4 | 5 |
| Flight (W#1; HS, 40 m/s) | Spin rate (rpm) | 3,194 | 3,067 | 3,005 | 3,295 | 3,647 | 3,563 | 3,258 | 3,278 |
| | Total distance (m) | 204.0 | 204.9 | 205.6 | 201.8 | 198.2 | 199.1 | 202.2 | 201.5 |
| | Rating | good | good | good | NG | NG | NG | NG | NG |
| Feel | Rating | good | good | good | good | NG | NG | good | good |

The results in Table 5 show that the respective comparative examples were inferior to the present invention (working examples) in the following ways.

In Comparative Example 1, wherein the outer layer was softer than the outer intermediate layer, the spin rate of the ball increased and the rebound decreased, as a result of which a good distance was not achieved.

In Comparative Example 2, because the outer layer had a Shore D hardness which was softer than the average Shore D hardness of the core and was softer than both the inner and outer intermediate layers, the spin rate of the ball increased and the rebound decreased, as a result of which a good distance was not achieved.

In Comparative Example 3, because the outer layer had a Shore D hardness which was the same as the average Shore D hardness of the core, the spin rate of the ball increased and the rebound decreased, as a result of which a good distance was not achieved.

Comparative Example 4 was a five-piece solid golf ball having four cover layers. The spin rate-lowering effect of the ball on shots with a driver (W#1) was inadequate, as a result of which the distance was poor.

Comparative Example 5 was a four-piece solid golf ball having three cover layers. The spin rate-lowering effect of the ball on shots with a driver (W#1) was inadequate, as a result of which the distance was poor.

The invention claimed is:

1. A multi-piece solid golf ball comprising a core, an envelope layer encasing the core, an intermediate layer encasing the envelope layer, and an outer layer which encases the envelope layer and has formed on a surface thereof a plurality of dimples, wherein the core is made of an elastomer, the envelope layer is formed of an inner envelope layer and an outer envelope layer, the intermediate layer is formed of an inner intermediate layer and an outer intermediate layer, and, letting the average hardness of the core be expressed by the following formula:

average core hardness (Shore *D*)=[core surface hardness (Shore *D*)+core center hardness (Shore *D*)]/2, the outer layer has a hardness (Shore D) which is higher than the average core hardness and each of the envelope layers and the intermediate layers is softer than the outer layer, wherein the envelope layers, the intermediate layers and the outer layer have Shore D hardnesses which satisfy the following relationship:

outer layer hardness>outer intermediate layer hardness>inner intermediate layer hardness>outer envelope layer hardness>inner envelope layer hardness, and wherein the outer intermediate layer and the outer layer have Shore D hardnesses which satisfy the following relationship:

3≤(outer layer hardness−outer intermediate layer hardness)≤20.

2. The multi-piece solid golf ball of claim 1, wherein the core, the envelope layers, the intermediate layers and the outer layer have Shore D hardnesses which satisfy the following four relationships:

1≤(outer intermediate layer hardness−inner intermediate layer hardness)≤10,

1≤(inner intermediate layer hardness−outer envelope layer)≤10,

1≤(outer envelope layer hardness−inner envelope layer hardness)≤10, and

5≤(outer layer hardness−average core hardness)≤40.

3. The multi-piece solid golf ball of claim 1, wherein the envelope layers, the intermediate layers and the outer layer have thicknesses which satisfy the following relationship:

1≤(outer intermediate layer thickness+inner intermediate layer thickness+outer envelope layer thickness+inner envelope layer thickness)/outer layer thickness≤4.0.

4. The multi-piece solid golf ball of claim 1, wherein the outer layer is formed of a material composed primarily of an ionomer, and the outer layer material includes one or more type of ionomer resin having an acid content of at least 16 wt %.

5. The multi-piece solid golf ball of claim 1, wherein the core, envelope layers, intermediate layers and outer layer have Shore D hardnesses which satisfy the following relationship:

outer layer hardness>outer intermediate layer hardness>inner intermediate layer hardness>outer envelope layer hardness>inner envelope layer hardness>center core hardness.

6. The multi-piece solid golf ball of claim 1, wherein the envelope layers, intermediate layers and outer layer have thicknesses which satisfy the following relationship:

outer layer thickness≤(outer intermediate layer thickness+inner intermediate layer thickness+outer envelope layer thickness+inner envelope layer thickness)<core diameter.

7. The multi-piece solid golf ball of claim 1, wherein at least one layer from among the inner envelope layer, outer envelope layer, inner intermediate layer and outer intermediate layer is formed of a material obtained by blending:

an ionomer resin component of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50.

8. The multi-piece solid golf ball of claim 1, wherein at least one layer from among the inner envelope layer, outer envelope layer, inner intermediate layer and outer intermediate layer is formed of a material obtained by blending:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from 5 to 120 parts by weight of a fatty acid and/or fatty acid derivative having a molecular weight of from 228 to 1500; and (d) from 0.1 to 17 parts by weight of a basic inorganic metal compound capable of neutralizing un-neutralized acid groups in the base resin and component (c).

9. The multi-piece solid golf ball of claim 8, wherein at least two layers from among the inner envelope layer, outer envelope layer, inner intermediate layer and outer intermediate layer are formed of the material of claim 8.

10. The multi-piece solid golf ball of claim 8, wherein at least three layers from among the inner envelope layer, outer envelope layer, inner intermediate layer and outer intermediate layer are formed of the material of claim 8.

11. The multi-piece solid golf ball of claim 8, wherein the inner envelope layer, outer envelope layer, inner intermediate layer and outer intermediate layer are all formed of the material of claim 8.

12. The multi-piece solid golf ball of claim 1, wherein the core, envelope layers, intermediate layers and outer layer have thicknesses which satisfy the following four relationships:

0.75≤(outer intermediate layer thickness+inner intermediate layer thickness)/outer layer thickness≤1.5, 0.75≤(outer envelope layer thickness+inner envelope layer thickness)/outer layer thickness≤1.5, 0.75≤(outer intermediate layer thickness+inner intermediate layer thickness)/(outer envelope layer thickness+inner envelope layer thickness)≤1.5, and outer layer thickness<(outer intermediate layer thickness+inner intermediate layer thickness+outer envelope layer thickness+inner envelope layer thickness)<core diameter.

13. A multi-piece solid golf ball comprising a core, an envelope layer encasing the core, an intermediate layer encasing the envelope layer, and an outer layer which encases the envelope layer and has formed on a surface thereof a plurality of dimples, wherein the core is made of an elastomer, the envelope layer is formed of an inner envelope layer and an outer envelope layer, the intermediate layer is formed of an inner intermediate layer and an outer intermediate layer, and, letting the average hardness of the core be expressed by the following formula:

average core hardness (Shore $D$)=[core surface hardness (Shore $D$)+core center hardness (Shore $D$)]/2, the outer layer has a hardness (Shore D) which is higher than the average core hardness and each of the envelope layers and the intermediate layers is softer than the outer layer, wherein the core, envelope layers, intermediate layers and outer layer have thicknesses which satisfy the following four relationships:

0.75≤(outer intermediate layer thickness+inner intermediate layer thickness)/outer layer thickness≤1.5, 0.75≤(outer envelope layer thickness+inner envelope layer thickness)/outer layer thickness≤1.5, 0.75≤(outer intermediate layer thickness+inner intermediate layer thickness)/(outer envelope layer thickness+inner envelope layer thickness)≤1.5, and outer layer thickness<(outer intermediate layer thickness+inner intermediate layer thickness+outer envelope layer thickness+inner envelope layer thickness)<core diameter.

14. The multi-piece solid golf ball of claim 13, wherein the outer layer and the outer intermediate layer have Shore D hardnesses which satisfy the following relationship:

3≤(outer layer hardness−outer intermediate layer hardness)≤20.

15. The multi-piece solid golf ball of claim 13, wherein the intermediate layers and the outer envelope layer have Shore D hardnesses which satisfy the following two relationships:

1≤(outer intermediate layer hardness−inner intermediate layer hardness)≤10, and

1≤(inner intermediate layer hardness−outer envelope layer hardness)≤10.

16. The multi-piece solid golf ball of claim 13, wherein the outer envelope layer and the inner envelope layer have Shore D hardnesses which satisfy the following relationship:

1≤(outer envelope layer hardness−inner envelope layer hardness)≤10.

17. The multi-piece solid golf ball of claim 13, wherein the core and the outer layer have Shore D hardnesses which satisfy the following relationship:

5≤(outer layer hardness−average core hardness)≤40.

18. The multi-piece solid golf ball of claim 13, wherein the core, envelope layers, intermediate layers and outer layer have Shore D hardnesses which satisfy the following relationship:

outer layer hardness>outer intermediate layer hardness>inner intermediate layer hardness>outer envelope layer hardness>inner envelope layer hardness>center core hardness.

19. The multi-piece solid golf ball of claim 13, wherein the envelope layers, intermediate layers and outer layer have thicknesses which satisfy the following relationship:

outer layer thickness≤(outer intermediate layer thickness+inner intermediate layer thickness+outer envelope layer thickness+inner envelope layer thickness)<core diameter.

* * * * *